US005335586A

United States Patent [19]

Casto et al.

[11] Patent Number: 5,335,586

[45] Date of Patent: Aug. 9, 1994

[54] HANDLE LINKAGE

[75] Inventors: Mark R. Casto, Washington Court House; Jeffrey A. Batten, Piqua; Raymond J. Mathieu, Ludlow Falls, all of Ohio

[73] Assignee: MAC Tools, Inc., Washington Court House, Ohio

[21] Appl. No.: 943,441

[22] Filed: Sep. 10, 1992

[51] Int. Cl.[5] ..... F01B 9/00

[52] U.S. Cl. ..... 92/140; 74/105; 74/106; 74/524

[58] Field of Search ..... 92/140; 74/99 R, 103, 74/105, 106, 520, 523, 524

[56] References Cited

U.S. PATENT DOCUMENTS

| | | | |
|---|---|---|---|
| 670,416 | 3/1901 | Cronk | 74/523 |
| 1,282,818 | 10/1918 | Hall | 74/105 |
| 2,936,011 | 5/1960 | O'Leary | 74/106 |
| 3,012,446 | 12/1961 | Muehl | 74/524 |
| 4,934,204 | 6/1990 | Hadden | 74/105 |
| 5,141,519 | 8/1992 | Smith et al. | 74/105 |

OTHER PUBLICATIONS

MAC Tools catalog. p. 246, showing vacuum pumps, Parts Nos. MV74000 and MV4000, having known handle linkages (date unknown).

*Primary Examiner*—Edward K. Look
*Assistant Examiner*—F. Daniel Lopez
*Attorney, Agent, or Firm*—Porter, Wright, Morris & Arthur

[57] ABSTRACT

A handle linkage including two handle arms rotatably secured to each other, while one handle arm is attached to the body of a tool and the other handle arm is attached to an actuatable member of the tool. One or more links connect the actuatable member to the second handle arm allowing for substantially linear movement of the actuatable member into the body of the tool.

8 Claims, 3 Drawing Sheets

HANDLE LINKAGE

BACKGROUND AND SUMMARY OF THE INVENTION

The present invention relates generally to linkage assemblies, and more particularly, to a linkage for a handle apparatus attached to a tool.

Tools, such as hand tools that may require an actuatable member, such as a piston rod, to be actuated to result in a variety of certain mechanical advantages, are easier to use if smooth movement of the rod is not inhibited. For example, in hand tools such as pressure pumps or vacuum pumps a handle assembly is squeezed together by an operator's hand to actuate a piston rod to move within a cylinder and thereby create either a pressure or a vacuum as is known to those of ordinary skill in the art. For extended use of the piston cylinder assembly and for achieving optimum performance from the hand tool it is advantageous to guide the piston rod of such an assembly in a manner that does not tend to buckle or bind the rod but instead provides for perfectly linear actuation of the rod. Lateral movement of the rod could cause damage to the rod, piston, or cylinder and could also hinder smooth and easy operation of the hand tool. Known linkages attached to the piston rod have been known to suffer from a tendency to buckle or bend the rod during operation of such a hand tool.

The present invention is designed to overcome the above mentioned problems associated with known handle linkages for hand tools and other devices which would benefit from substantial linear movement of a rod without a tendency to buckle or bend the rod. The present invention offers a unique handle linkage for use with such tools as hand held pressure pumps and vacuum pumps as well as other devices of a similar nature.

The present invention includes two handle arms, one secured at its proximal end to the body of a hand tool, such as the cylinder of a pressure pump tool, and a distal end extending therefrom. The second handle arm is movable and rotatably secured to a portion of said first handle arm. The second handle arm proximal end is engaged with a linkage that is secured to a piston rod in one embodiment of the present invention. The distal end of the second handle arm extends therefrom to oppose the distal end of the first handle arm. By forcing the distal end of the second handle arm to move towards the distal end of the first handle arm, the proximal end of the second handle arm is caused to move in a direction either toward or away from the body of the tool depending on whether the tool in this embodiment is a pressure pump (toward) or a vacuum pump (away from). Since the proximal end of the second handle arm is attached by the linkage to the rod of the assembly, as it moves towards the body of the tool in the case of a pressure pump it will drive the rod into the body or cylinder of the tool. The linkage of the present invention is designed to cause the rod to move in a linear fashion and not to bind or buckle as the second handle arm actuates the rod. To accomplish this preferably two linkage members or links are movably engaged with the proximal end of the second handle arm. The two linkage members are rotatably engaged with the rod at their respective ends opposite the ends engaged with the second handle arm. A protruding flange member of each link may be adapted to be engaged within a preferably hourglass shaped slot located in each of two spaced flange ends forming the proximal end of the second handle arm.

The invention will be shown and described in greater detail in the following drawings and detailed description:

DETAILED DESCRIPTION OF PREFERRED EMBODIMENT(S)

Figure 1:
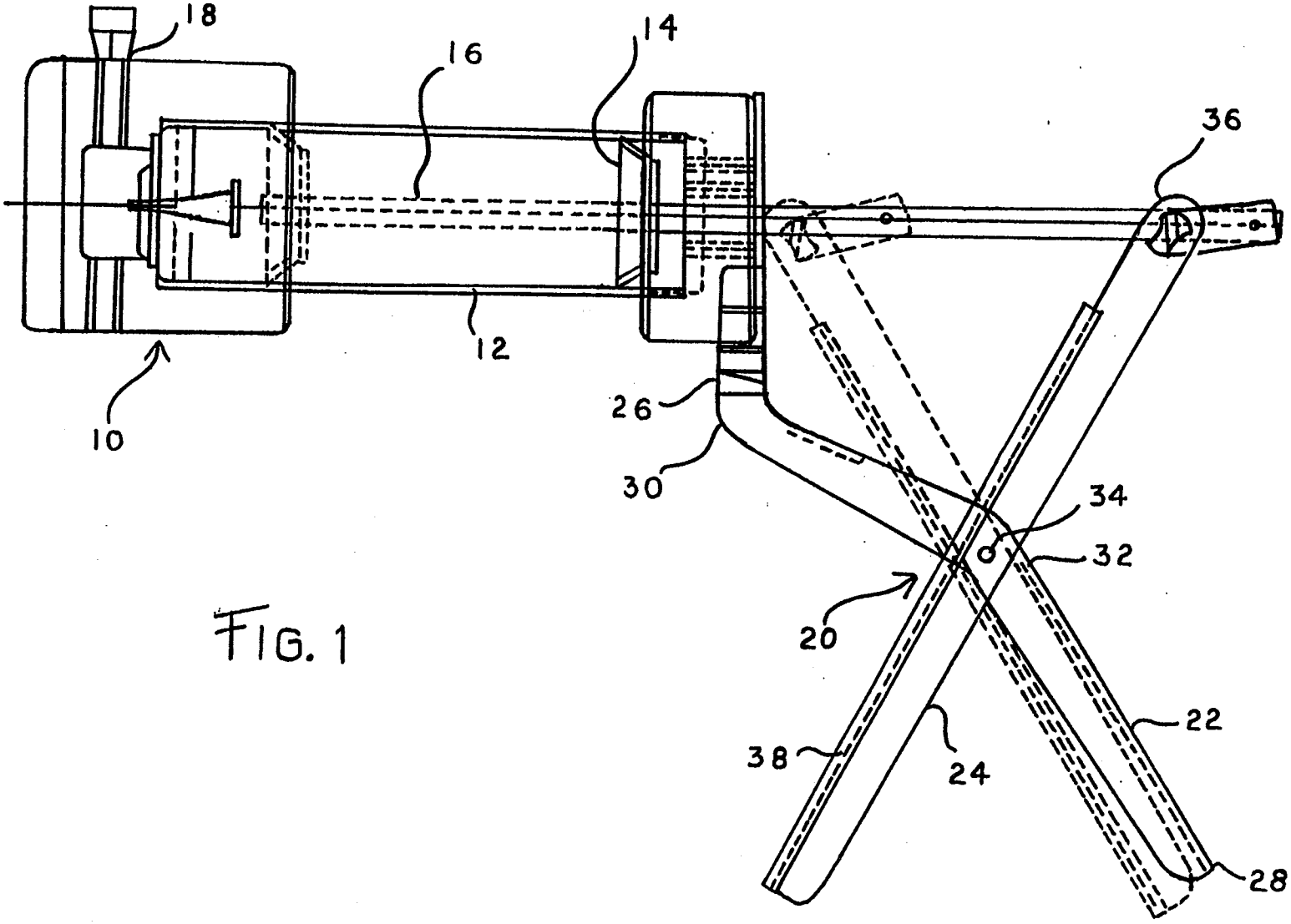
FIG. 1 is a side elevation view of the handle linkage assembly of the present invention attached to a pressure pump hand tool.

Referring now to the drawings, and particularly FIG. 1, there is shown a hand tool assembly 10 including a handle linkage assembly 20 of the present invention. The hand tool assembly 10 may include a body portion 12 which in the embodiment shown in the drawings is a cylinder adapted to receive a piston 14 and rod 16 for creating a source of air pressure at an exit end 18 of said body portion 12.

The handle linkage assembly 20 of the present invention includes a first handle arm 22 and a second handle arm 24 rotatably secured to said first handle arm 22. In one embodiment of the present invention as shown in FIG. 1, a proximal end 26 of the first handle arm 22 may be secured to the body portion 12 of the hand tool assembly 10. This securement is preferably rigid. Extending from the proximal end 26 is a distal end 28 of the first handle arm 22. The first handle arm 22 is preferably shaped to have two radius bends 30, 32 therein which cause the distal end 28 to be offset from and not in linear relationship to the proximal end 26.

Figure 2:
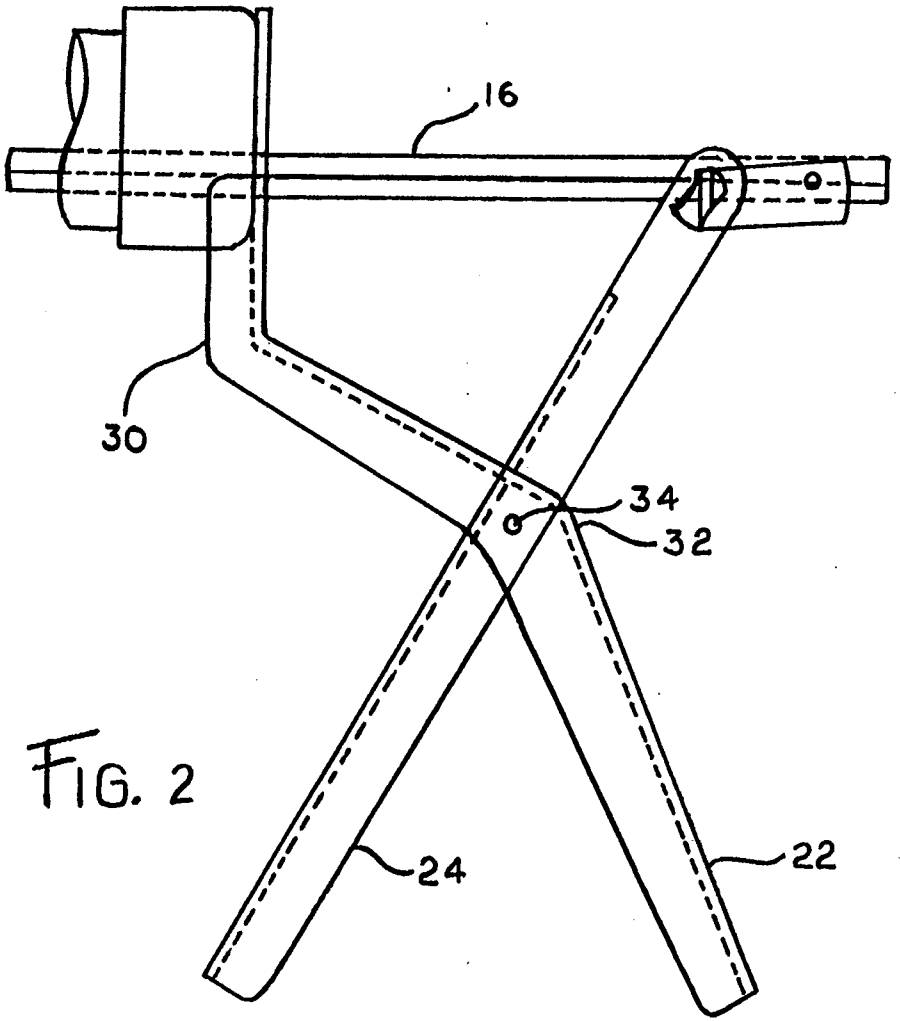
FIG. 2 is a partial side elevation view of the handle linkage assembly of FIG. 1 shown in its open position.
Figure 3:
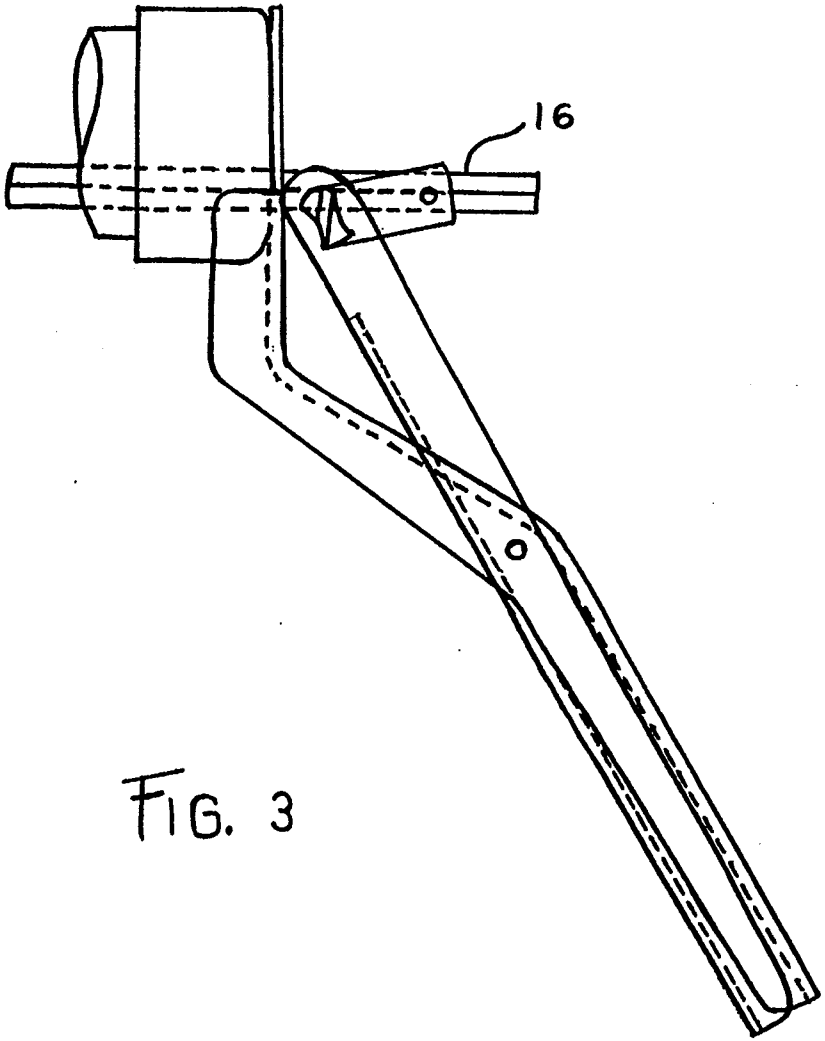
FIG. 3 is a partial side elevation view of the handle linkage assembly of FIG. 1 shown in its closed position.
Figure 4A:
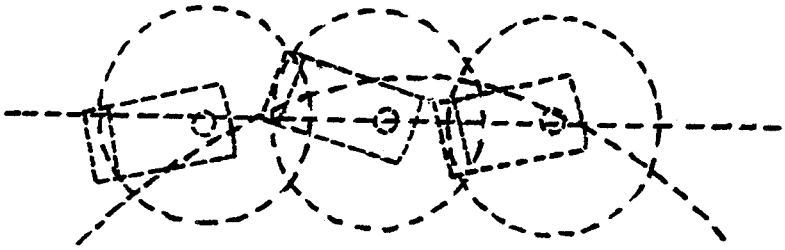
FIG. 4A is a view showing a partial range of motion of the link shown in FIG. 4.
Figure 4:
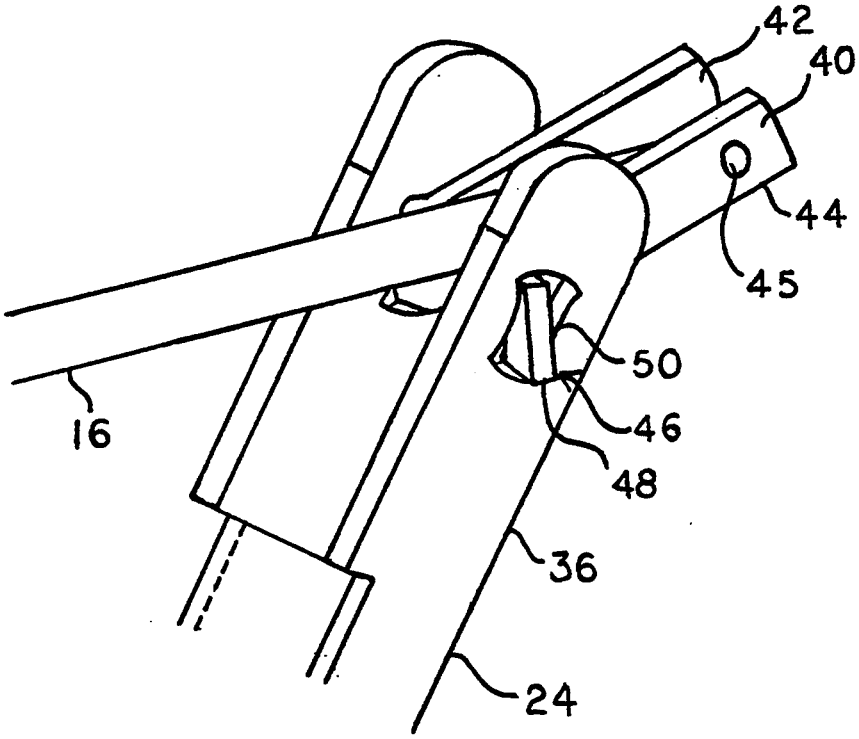
FIG. 4 is an enlarged perspective view of a preferred embodiment of the proximal end of the second handle arm of the present invention.

The second handle arm 24 is rotatably secured to a portion of the first handle arm 22. Preferably, this securement is a rivet 34 that may be spring wound to cause the first and second handle arms to open when not under force to move together. The second handle arm 24 has a proximal end 36 which indirectly attaches to the rod 16 as will be described hereinafter. Extending from the proximal end 36 is the distal end 38 of the second handle arm 24. When the distal end 38 of the second handle arm 24 is forced toward the distal end 28 of the first handle arm 22, the second handle arm rotates about the rivet 34, causing the proximal end 36 of the second handle arm 24 to move towards the hand tool body portion 12, as shown in FIG. 3. To assist the second handle arm in returning to its open or start position as shown in FIG. 2, the rivet 34 may be spring wound which tends to cause the first and second handle arms to remain in an open configuration as shown in FIG. 2. Referring now to FIG. 4, the manner in which the proximal end of the second handle arm 24 is attached to an actuatable member such as the rod 16 is shown. At least one link 40 and preferable a second link 42 are pivotally attached to an end of the rod 16. The pivotable connection may be a simple pin connection 45. The link 40 is attached to the rod at its pivot end 44. At a swing end 46, the link 40 is turned creating a flange member 48 which is adapted to be engaged within a slot 50 in the proximal end 36. The slot 50 is preferably in an hourglass shape. As the proximal end 36 is moved towards the body portion 12, the swing end 46 of the link 40 will move radially with respect to its pivot end 44 about the pin connection. The flange member 48 will move within the slot 50 to an extent allowable by the shape and size of the slot. The resulting movement of the rod 16 is a linear movement, forcing the rod 16 into the body portion 12 of the tool assembly 10. To retract the rod 16 the proximal end 36 of the second handle arm 24 is moved in a reversed direction while the link 40 remains free to move as hereinbefore described.

It is thought that the handle linkage assembly of the present invention and many of its advantages will be understood from the foregoing description. It will be apparent that various changes may be made in the form and construction of the components thereof which are cited above for purposes of offering an example, without departing from the spirit and scope of the invention or sacrificing all of its material advantages. The form of the invention described above is merely a preferred or exemplary embodiment thereof.

What is claimed is:

1. A handle assembly for use on a hand operated tool comprising:

a first handle arm having a proximal end rigidly secured to a body portion of said tool and a distal end extending from said proximal end;

a second handle arm rotatably secured to a location on said first handle arm, said second handle arm having a proximal end linked with an actuatable member of said tool and a distal end extending from said proximal end of said second handle arm, such that as said second handle arm is forced to rotate about said location in a direction that would bring said distal end of said second handle arm closer to said distal end of said first handle arm, said actuatable member is caused to move in a linear direction; and at least one link having a pivot end and a swing end pivotably attached at its pivot end to said actuatable member and movably engaged at its swing end to said proximal end of said second handle arm, wherein said swing end of said link includes a flange turned at substantially 90° to said pivot end and said swing end is engaged within a generally hourglass shaped slot in said proximal end of said second handle arm.

2. The handle assembly of claim 1, wherein said tool is a pressure pump.

3. The handle assembly of claim 2, wherein said actuatable member is a piston rod.

4. The handle assembly of claim 1, wherein said first handle arm includes at least one radius bend therein resulting in said proximal end of said first handle arm being in a non-linear relationship with said distal end of said first handle arm.

5. The handle assembly of claim 1, wherein said first handle arm includes two separate radius bends therein.

6. The handle assembly of claim 1, wherein said handle arms are rotatably secured together by a spring loaded pin connection.

7. The handle assembly of claim 1, wherein said tool is a vacuum pump.

8. A handle assembly for use with a tool capable of manual operation, comprising:

a first handle arm having a proximal end in association with said tool and a distal end extending from said proximal end;

a second handle arm rotatably secured to a location on said first handle arm, said second handle arm having a proximal end linked with an actuatable member of said tool and a distal end extending from said proximal end of said second handle arm;

at least one link, having a pivot end and a swing end, pivotably attached at its pivot end to said actuatable member, and having a flange member forming a part of said swing end, said flange member adapted to be engaged within a slot in said proximal end of said second handle arm, such that as said first and second handle arms are forced together said actuatable member is caused to move in a linear direction.

* * * * *